United States Patent [19]

Chestnut

[11] 4,297,547

[45] Oct. 27, 1981

[54] MINIATURE TIMING MECHANISM

[75] Inventor: Benjamin F. Chestnut, Indianapolis, Ind.

[73] Assignee: Emhart Industries, Inc., Indianapolis, Ind.

[21] Appl. No.: 146,616

[22] Filed: May 5, 1980

Related U.S. Application Data

[63] Continuation of Ser. No. 969,349, Dec. 14, 1978, abandoned.

[51] Int. Cl.[3] ..... H01H 43/10

[52] U.S. Cl. ..... 200/38 R; 200/35 R; 200/38 B

[58] Field of Search ..... 200/35 R, 38 R, 38 A, 200/38 B, 38 BA, 38 C, 38 CA, 283

[56] References Cited

U.S. PATENT DOCUMENTS

| | | | |
|---|---|---|---|
| 3,500,005 | 3/1970 | Brown | 200/38 B |
| 3,553,720 | 1/1971 | Brown | 200/283 X |
| 3,727,015 | 4/1973 | Voland et al. | 200/38 R |
| 3,742,160 | 6/1973 | Murray et al. | 200/38 R |
| 3,814,874 | 6/1974 | Brown | 200/38 B |
| 3,823,280 | 7/1974 | Obermann et al. | 200/38 B |
| 4,045,626 | 8/1977 | Holper | 200/38 BA X |

*Primary Examiner*—James R. Scott

*Attorney, Agent, or Firm*—Robert F. Meyer; David W. Gomes

[57] ABSTRACT

A gear train is connected to a motor carried in a housing and has an output member extending into another housing, the output member having at least one cam lobe. Electrical switch means carried in the second housing are responsive to the cam lobe.

4 Claims, 3 Drawing Figures

MINIATURE TIMING MECHANISM

This application is a continuation of application Ser. No. 969,349, filed Dec. 14, 1978, now abandoned.

BACKGROUND OF THE INVENTION

Generally speaking the present invention relates to a timing mechanism comprising a motor and a gear train connected to the motor to be driven thereby, a first housing enclosing the gear train, a cup shaped second housing carried by the first housing at an open end thereof, an electrically insulative member closing the open end, an output member of the gear train extending through an opening in the insulative member into the cup shaped member, at least one cam lobe carried by the output member, and electrical switch means carried in the cup shaped member and responsive to the cam lobe.

The present invention pertains to a timing mechanism and more particularly to a timing mechanism wherein an output member of a gear train also serves as a cam for the timing mechanism.

Timing mechanisms have been used for many years in the appliance industry to control the sequence of operation of an appliance such as a washer. In some appliances such as dryers and microwave ovens, there needs to be short cycles or pulses of operation within an overall program. Therefore, in addition to the main timing mechanism there are applications where smaller timing mechanisms are used to provide a pulsing cycle within the overall timing mechanism. These timing mechanisms are usually very small with a minimum number of parts. As such the timing mechanism needs to be as small as possible with a minimum number of parts. The timing mechanism of the present invention will adequately provide this objective.

OBJECTS OR FEATURES OF THE INVENTION

It is, therefore, a feature of the present invention to provide a timing mechanism which is small and has a minimum number of parts. Another feature of the invention is the provision of such a timing mechanism wherein an output member of the gear train is used to provide a cam for the timing mechanism. Another feature of the invention is to provide such a timing mechanism wherein the gear train and the cam are each carried in separate housings with the output member extending from the gear train into the housing for the cam. Another feature of the invention is to provide a timing mechanism wherein the housing for the cam is a cup shaped member and wherein an electrically insulative member closes its open end. Still another feature of the invention is to provide such a timing mechanism wherein the output member comprises a gear carried in the gear train housing and a hub extending into the housing for the cam. Yet another feature of the invention is to provide such a timing mechanism wherein there are a pair of switch blades carried in the housing for the cam with one of the blades moving in response to the cam. Another feature of the invention is to provide such a timing mechanism wherein a stop means is carried on the housing for the cam and engages the other switch blade to limit its drop. These and other features of the invention will become apparent from the following description taken in conjunction with the drawings.

DETAILED DESCRIPTION OF THE DRAWINGS

Figure 1:
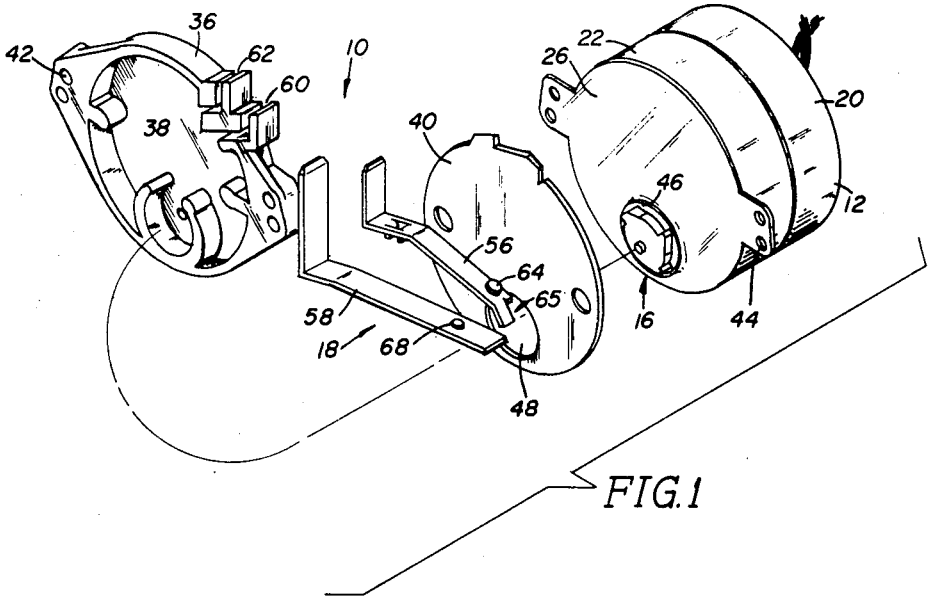
FIG. 1 is an exploded view of a timing mechanism employing the features of the invention.
Figure 2:
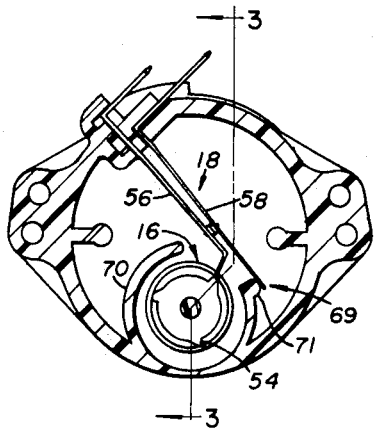
FIG. 2 is a section of the timing mechanism.
Figure 3:
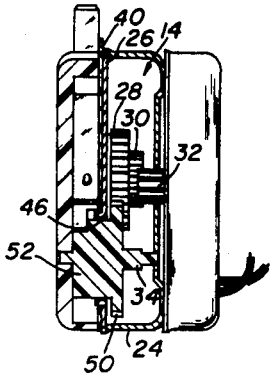
FIG. 3 is a section taken along the line 3—3 of FIG. 2.

Referring to the drawings, there is shown a timing mechanism 10 employing the features of the invention. In general timing mechanism 10 includes a motor 12, a gear train 14 connected to the motor to be driven thereby, a cam means 16, and switch means 18 responsive thereto. Motor 12 could be of the synchronous motor type and is enclosed in a housing 20. The details of the motor are well known in the art and therefore are not shown. Gear train 14 is enclosed in a housing 22 which comprises a cup shaped member 24 closed by plate 26. As shown, gear train 14 includes a series of gears and pinions 28 and 30 connected between the output pinion 32 of the motor and an output member 34 for the gear train.

Cam means 16 and switch means 18 are enclosed in a housing 36 which includes a cup shaped member 38. The cup shaped member is closed by an electrically insulative member 40. Housing 36 is carried by housing member 22 through screws which threadedly engage aperture 42 and 44 of the housings. As shown, output member 34 is rotationally journalled in cup shaped members 24 and 36 and extends through a bearing surface 46 formed from plate 26 and extending into an aperture 48 of insulative member 40. Output member 34 includes a gear 50 of the gear train with a hub portion 52 extending from the gear and having at least one cam lobe 54 extending therefrom to provide cam means 16.

Switch means 18 includes a pair of electrical switch blades 56 and 58 which are cantilevered in housing 36 through slots 60 and 62, and electrical contacts 64 and 68 carried by the blades. Blade 56 includes means 65 engaging the blades with cam means 16. In the present embodiment such means includes a bent over extension 65 of the blade. Stop means 69 is carried by housing 36 to limit the drop of blade 56. Stop means 69 includes post 71 formed as part of a cover 70 for cam means 16. As shown, cover 40 is aligned with the outer surface of bearing surface 46 in order to insure alignment of housing 36 and therefore switch blades 56 and 58 with cam means 16. Electrical terminals 72 and 74 are integral with the blades and extend outside the housing.

In operation, when electrical power is applied to motor 12 output pinion 32 drives gear train 14 to rotate its output member 34 to rotate cam lobe 54 to open and close electrical contacts 64 and 68.

What is claimed is:

1. A timing mechanism comprising:

(a) a motor and a gear train connected to said motor to be driven thereby, (b) a first housing enclosing said gear train, (c) a cup shaped second housing carried by said first housing at an open end thereof, (d) an electrically insulative member closing said open end, (e) a bearing surface provided in said first housing and extending through an opening in said electrically insulative member, (f) a gear of said gear train carried within said first housing and having a unitarily constructed hub portion extending through said opening in said insulative member into said cup shaped member and at least one cam lobe unitarily constructed with said hub portion, (g) electrical switch means carried in said cup shaped member and responsive to said cam lobe, and (h) a circular cover carried by said cup shaped member and partially surrounding said cam lobe and in line with said opening and an outer surface of said bearing surface.

2. A timing mechanism according to claim 1 wherein said electrical switch means includes a pair of switch blades, means carried by one of said switch blades engaging said cam lobe, and an electrical contact carried by each of said switch blades and engaging each other.

3. A timing mechanism according to claim 2 further comprising a stop means carried by said second housing and engaging the other of said pair of switch blades to limit its travel.

4. In a timing mechanism according to claim 3 wherein said stop means is a post.

* * * * *